US005437297A

United States Patent [19]

Crisman et al.

[11] Patent Number: 5,437,297

[45] Date of Patent: Aug. 1, 1995

[54] CRANK HANDLE ASSEMBLY FOR USE IN AN UMBRELLA

[75] Inventors: David H. Crisman, Baraboo, Wis.; Glen D. Kemnitz, Gallatin, Tenn.

[73] Assignee: Sunbeam Corporation, Fort Lauderdale, Fla.

[21] Appl. No.: 969,641

[22] Filed: Oct. 30, 1992

[51] Int. Cl.[6] ..... A45B 25/14; G05G 1/08

[52] U.S. Cl. ..... 135/20.1; 264/242; 135/20.3; 135/25.4; 135/908; 74/545

[58] Field of Search ..... 152/20.1, 20.2, 20.3, 152/15.1, 16, 24, 25.4, 910, 911; 74/543, 545, 594.1, 594.2, 527, 558.5; 264/242, 259, 328.1, 271.1, 279; 135/908, 20.1, 20.3, 25.4

[56] References Cited

U.S. PATENT DOCUMENTS

| | | | |
|---|---|---|---|
| 737,603 | 9/1903 | Fritz | 74/594.2 |
| 1,989,420 | 1/1935 | Keeler | 74/545 |
| 2,496,700 | 2/1950 | Cole | 74/543 |
| 2,595,697 | 5/1952 | Pereira | 135/20.3 |
| 2,661,752 | 12/1953 | Kampf et al. | 135/20 |
| 2,819,725 | 3/1956 | Deisenroth et al. | 135/20 |
| 2,863,466 | 12/1956 | Small | 135/20 |
| 3,142,307 | 7/1964 | Daneiart et al. | 135/20.3 |
| 3,354,529 | 11/1967 | James | 264/279 X |
| 3,410,285 | 11/1968 | Small | 135/20 |
| 3,489,157 | 5/1968 | Pearlstine | 135/20 |
| 3,547,407 | 12/1970 | Ratcliff | 74/543 X |
| 3,924,775 | 12/1975 | Andreaggi et al. | 74/527 |
| 4,031,601 | 6/1977 | Staub et al. | 264/279 X |
| 4,319,600 | 3/1982 | Roche | 135/20 M |
| 4,382,562 | 5/1983 | Neufeld | 74/558.5 |
| 4,619,281 | 10/1986 | Redl et al. | 135/20 M |
| 4,622,987 | 11/1986 | Redl et al. | 135/20 M |
| 4,697,606 | 10/1987 | Ma | 135/20.3 |
| 4,821,597 | 4/1989 | Mareiniak et al. | 74/545 |

*Primary Examiner*—Carl D. Friedman
*Assistant Examiner*—Wynn E. Wood
*Attorney, Agent, or Firm*—Michael J. Kline; Darren E. Wolf; Carol I. Bordas

[57] ABSTRACT

An improved crank handle assembly for a shade umbrella suitable for patio or beach use, which has a bolt and a crank formed as a unitary member where the head of the bolt is insert molded into the hub of the crank in its manufacture. An annular spacer is mounted on each end of the bolt. An end of the bolt has a reduced threaded portion, which receives a washer and a nut, and the main body of the bolt forms a shoulder adjacent to the threaded portion. The washer abuts against the shoulder and one of the spacers at one end of the bolt. Tightening of the nut causes the washer to bottom out against the shoulder, and the annular spacers to abut against the umbrella pole applying a predetermined amount of compressive force to the crank handle assembly and the umbrella pole.

23 Claims, 3 Drawing Sheets

CRANK HANDLE ASSEMBLY FOR USE IN AN UMBRELLA

BACKGROUND OF THE INVENTION

1. Field of the Invention

The invention relates to a crank handle assembly and more particularly, concerns an improved crank handle assembly which can especially be used for opening and closing a foldable umbrella.

2. Description of the Prior Art.

Foldable or collapsible umbrellas used to provide a shady environment normally are available in large sizes. Typical of such shade providing umbrellas are those which are used on the beach, lawn, patio, terrace, and the like. For these umbrellas, it has been customary to include a wind-up mechanism or a crank handle assembly for raising and lowering the cover of the umbrella.

Examples of rotatable handles on crank assemblies for use on shade-type umbrellas are described in U.S. Pat. Nos. 2,661,752; 4,319,600; 4,619,281; and 4,622,987. Wind-up mechanisms are also available on umbrellas which tilt, examples of which are described in U.S. Pat. Nos. 2,819,725; 2,863,466; 3,410,285; and 3,489,147. Some or all of these aforementioned patents disclose variations of a construction for a crank handle assembly mounted on a pole of an umbrella. The construction for a crank handle assembly of the prior art may involve several components and complicated parts, and a complicated procedure for assembling the crank handle assembly on or in the pole of the umbrella.

Therefore, in spite of the prior art devices, there remains a very real and substantial need for an improved crank handle assembly for the operation of a cover of an umbrella, which assembly is simple in construction and simple to assemble or mount on a pole of the umbrella.

SUMMARY OF THE INVENTION

The present invention has met the above-described need. It employs a crank handle assembly having a handle and an elongated bolt which are formed as a unitary piece. This unitary piece could be plastic, metal, or any other suitable material. This unitary piece will generally consist of the bolt which could be metal and around which a resin material has been molded to form the handle.

The main body of the bolt has a head portion on one end which is insert molded in the crank handle and a reduced threaded portion on the opposite end. A main body of the bolt has a shoulder adjacent to the threaded portion. The shoulder serves as a stop upon tightening of a nut on the threaded portion. The nut is of the self-locking type to assure that it does not loosen during operation of the crank handle assembly.

The bolt is easily moved through openings in a tubular hollow pole of the umbrella and secured thereto at the one end by a washer and the nut. The bolt passes through spacers which are received in openings in the umbrella pole. Each spacer has a hub portion which extends into the pole openings and an enlarged portion which abuts against the outer wall of the pole when the crank handle is assembled on the pole. The inner wall of this enlarged portion has an arcuate configuration where the diametrical ends of the spacers have a radii which matches that of the pole for fitting against the umbrella pole. For ease in assembling, one spacer is placed on the bolt adjacent to the hub of the crank handle prior to the bolt passing through the openings in the pole. Another spacer is mounted on the bolt near the threaded portion and extends into its respective pole opening.

The washer and nut are mounted on the threaded portion and the washer is caused to abut against the shoulder of the main body of the bolt and the spacer disposed adjacent to the washer when the nut is tightened. Tightening of the nut causes the washer to bottom out against the shoulder, and the two spacers are pressed against the umbrella pole. The shoulder acts as a means for limiting the compression on the crank handle assembly and the umbrella pole.

A uniform predetermined compression for the crank handle assembly is achieved since the dimensions of the bolt including the shoulder, and other components of the crank handle assembly are controlled within very close tolerances in the manufacturing thereof.

Therefore, it is an object of the present invention to provide a crank handle assembly and a method for assembling thereof, which assembly has fewer parts than those crank handle assemblies of the prior art, and which crank handle assembly is simple and easy to mount.

It is a further object of the present invention to provide a crank handle assembly and a method for assembling thereof, which inherently sets a predetermined amount of compressive force on thee mounting element in the area where the crank is secured.

It is a still further object of the present invention to provide a crank handle assembly consisting of a crank handle and bolt which are a unitary piece.

It is a further object of the present invention to provide a crank handle assembly with a bolt which is insert molded into the crank handle.

It is a further object of the present invention to provide a crank handle assembly with a bolt which is insert molded into the crank handle and the bolt is fixedly secured to the crank handle for rotation with the crank handle.

It is a still further object of the present invention to provide a crank handle assembly whereby the dimension considered from a shoulder of the bolt to the shoulder on the crank handle sets a predetermined amount of compressive force on an umbrella pole.

These and other objects of the present invention will be fully understood and appreciated from the following description of the invention on reference to the illustrations appended hereto.

DETAILED DESCRIPTION OF THE DRAWINGS

Figure 1:
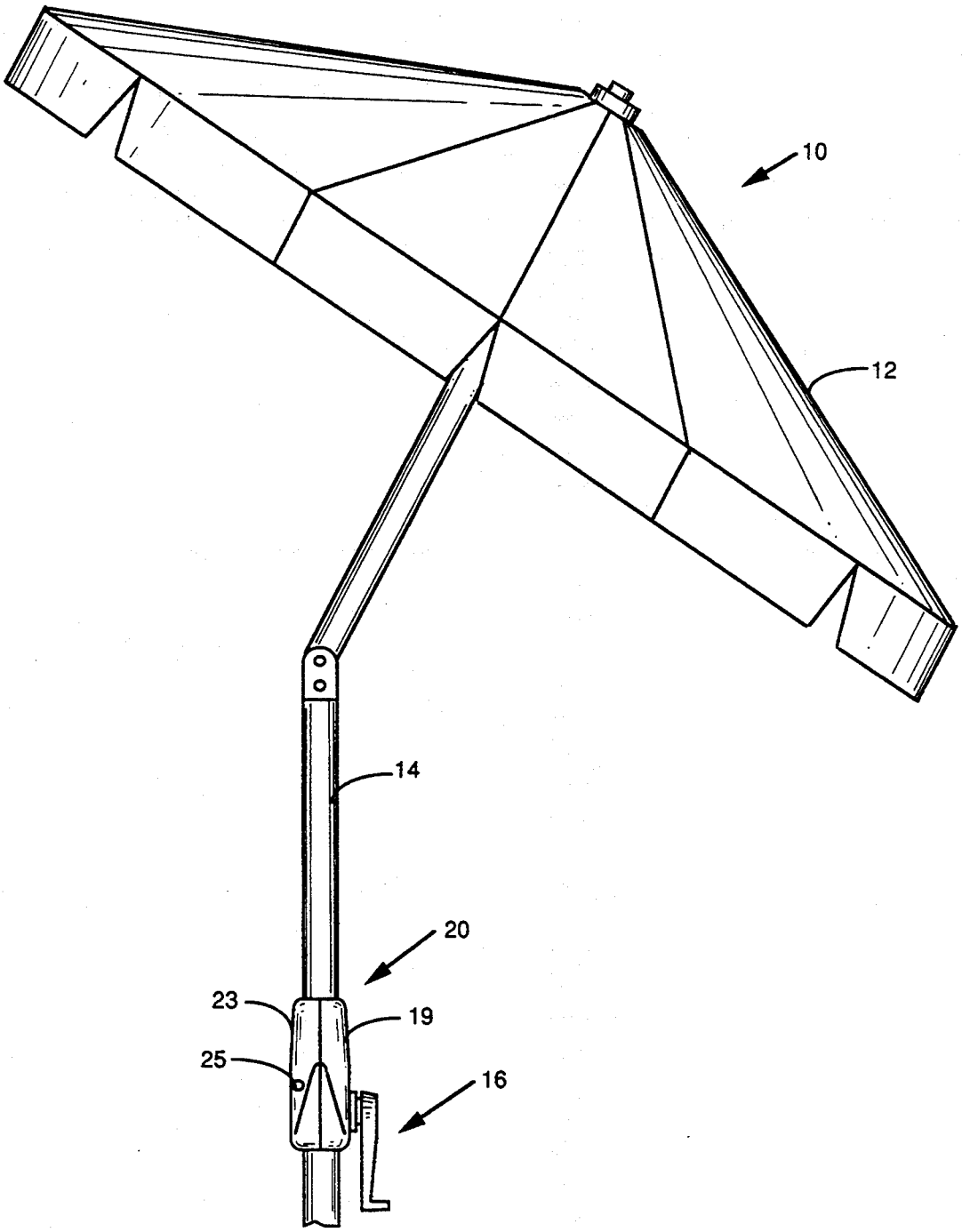
FIG. 1 is a side elevational view of an umbrella employing the crank handle assembly of the present invention on the umbrella pole.

Referring to FIG. 1, there is shown an umbrella in a tiltable and an open position. Umbrella 10 consists of a collapsible cover 12, a supporting post or pole 14, and a crank handle assembly 16 of the present invention. Umbrella 10 is ideally suitable for outdoor use, for providing shade, for example, on the beach, lawn, patio, garden and other outdoor uses. Umbrella 10 may be of the type that may be placed through an opening of a patio table.

Pole 14 supports collapsible cover 12, and crank handle assembly 16 opens and closes cover 12. Crank handle assembly 16, which is to be described hereinafter is not to be restricted to umbrellas for shade purposes, but could be used on any umbrella-type product in which a crank handle assembly for wind-up purposes is used to open and close a cover. Also, crank handle assembly 16 is not to be restricted to umbrellas, as such, but could be used in any type of device or product of manufacture which requires a crank for various purposes.

Still referring to FIG. 1, pole 14 extends generally downwardly with respect to cover 12. Even though post 14 is illustrated as being tiltable, it is within the scope and spirit of the invention for the umbrella to be straight and in one section, such as described in any of this type of umbrella in the U.S. Patents listed hereinbefore.

The construction and operation of collapsible cover 12 may follow the teachings of any of the aforesaid U.S. patents where a cable 55 is attached to a shaft of the crank handle assembly and wound therearound upon rotation of crank handle assembly. In effect, when crank handle assembly 16 of the invention is rotated, cover 12 is either raised in an open position, or lowered in a closed position as is well known in the art, and more about which will be described hereinafter.

Figure 2:
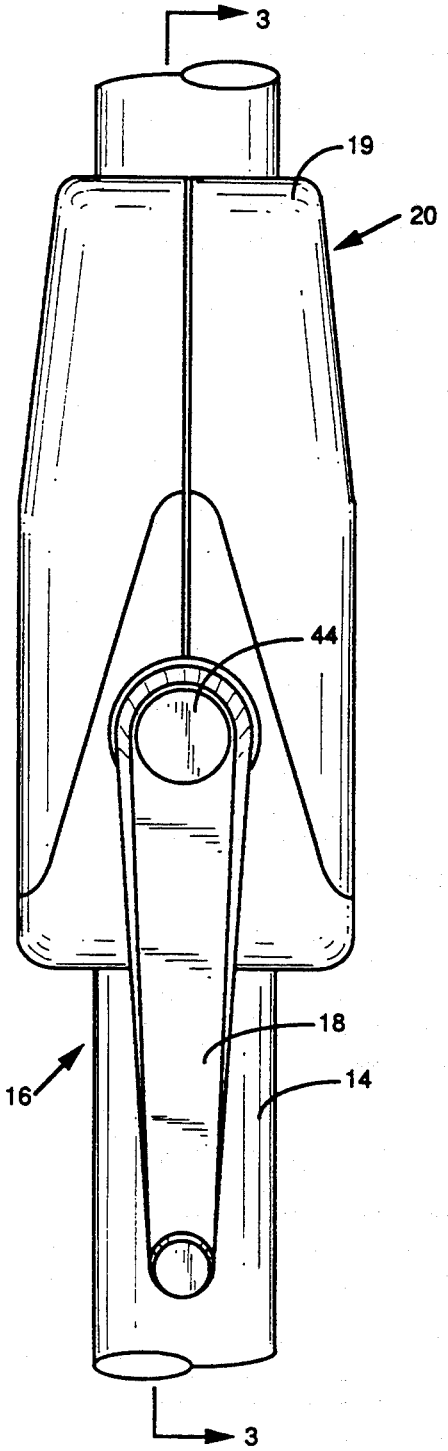
FIG. 2 is an enlarged side elevational view of the crank handle assembly of the present invention assembled and mounted on an umbrella pole.

As shown in FIGS. 1 and 2, crank handle assembly 16 is mounted on pole 14 and has a crank 18. So as to provide for smooth rotation of crank 18 and the mechanism for holding crank 18 onto pole 14, a housing 20 is provided, which is an encasement which encircles the outer diameter of pole 14, and the crank handle assembly 16. Housing 20 consists of two members 19 and 23 which are connected together by fastening means, such as screws, one of which is indicated at 25 in FIG. 1, more about which will be discussed hereinafter. Members 19, 23 of housing 20 are made of injection molded plastic, and have top and bottom arcuate inlets whose radii matches the diameter of pole 14 so that when members 19 and 20 are fastened together they fit snugly around pole 14.

Figure 3:
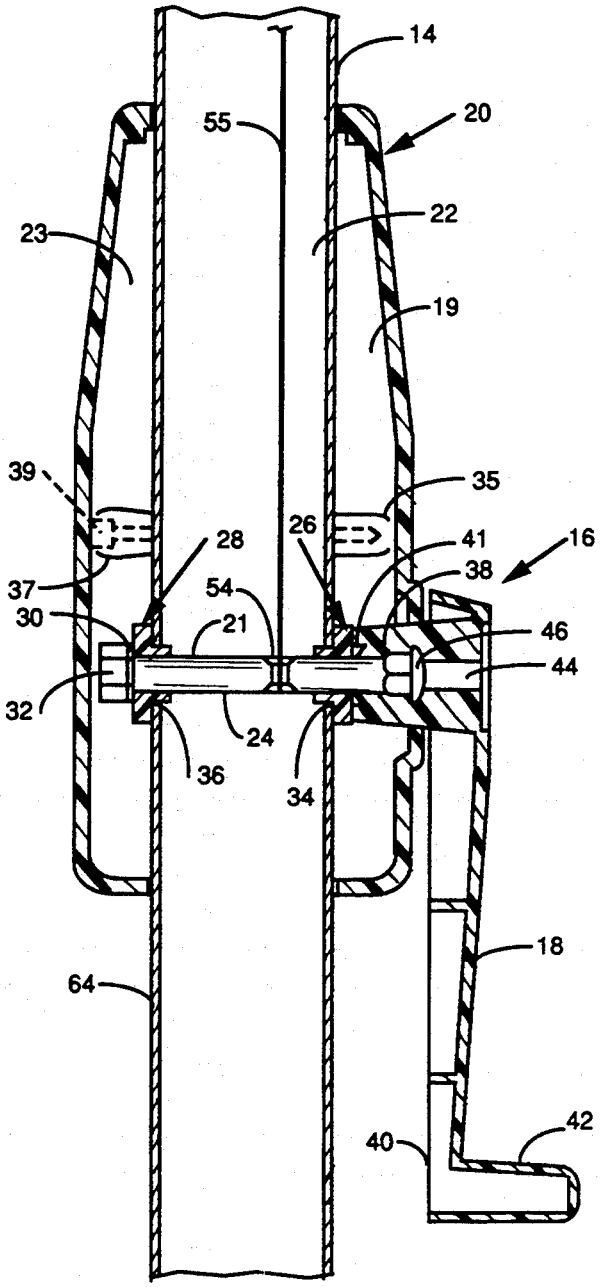
FIG. 3 enlarged cross-sectional view of the crank handle assembly of the present invention taken along lines 3—3 of FIG. 2.
Figure 4:
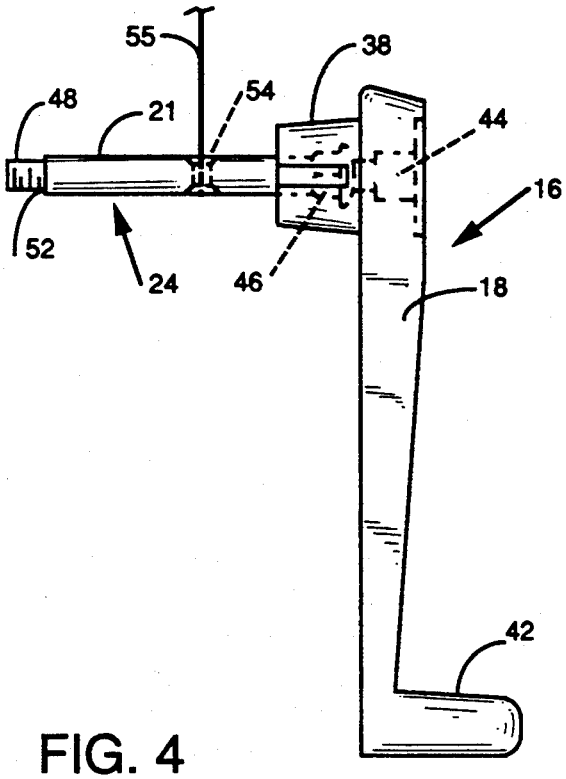
FIG. 4 an enlarged elevational view of the bolt insert molded in the crank forming a unitary piece crank handle assembly of the present invention illustrating.

Turning now to FIGS. 3 and 4, the details of crank handle assembly 16 of the present invention will be further illustrated and discussed. As particularly seen in FIG. 3, pole 14 is preferably a tubular member with a hollow interior 22. Preferably, this tubular member is made of aluminum.

Referring particularly to FIG. 3, crank handle assembly 16 consists of crank 18, an elongated bolt 24, annular spacers or inserts 26 and 28, washer 30, and nut 32. Bolt 24 extends transversely across pole 14 and through round openings 34 and 36 for the mounting of crank handle assembly 16 to pole 14 supporting cover 12 or any other external device requiring a crank.

Directly above bolt 24 in FIG. 3, are screw bosses 35 and 37 in plastic housing members 19 and 23, respectively, which receive screw 39. Boss 35 in member 19 consists of a hole which is sized for screw threads, and boss 37 of member 23 has a counter bored recess for the head of screw 39. Screw 39 is received in boss 37 and self threads into bosses 35 and 37 for clamping members 19 and 23 together on one side thereof. Screw 39 is located on one side of pole 14, but it is to be understood that a second arrangement of bosses and screw is provided on the other side of pole 14 out of FIG. 3.

Mounted on both sides of the shank 21 of bolt 24 are spacers 26 and 28, and mounted on a threaded end 48 of bolt 24, which is best shown in FIG. 4, is washer 30 and nut 32, as shown in FIG. 3.

FIG. 4 best illustrates crank 18 and bolt 24 of crank handle assembly 16 of FIG. 3. The shank 21 of bolt 24 has generally a cylindrical configuration. Crank 18 has a hub 38, arm 40, handle 42, and a recessed cavity 44 which is counter sunk into the body of crank 18. Crank 18 is journalled in and freely rotatable in spacers 26 and 28, which act as bushings.

Member 19 of housing 20 has an annular opening (not shown) for receiving hub 38 of crank 18.

Referring again to FIG. 3, bolt 24 has a head portion 46 at its one end and a threaded portion 48 at its other end. Head portion 46 is secured in hub 38 of crank 18 adjacent to recessed cavity 44, and is cantileverly supported therein. As shown in FIGS. 3 and 4, there are no clearances between head portion 46 of bolt 24, and hub 38 of crank 18. Head portion 46 and a part of the shank 21 of bolt 24 are integrally formed in crank 18. That is, in the molding process, bolt 24 is molded into hub 38 of crank 18 by injecting a resin material around bolt 24. Thus, crank 18 and bolt 24 are integrally formed as a unitary structure, and bolt 24 is fixedly secured in hub 38 with no relative movement therebetween, in a cantilever manner. Preferably, bolt 24 is made of metal and crank 18 is made of plastic. However, in some applications, bolt 24 may be of the same material as crank 18 or of some other plastic material. In FIG. 4, shaft 21 is cantileverly supported in crank 18. The materials for crank 18 and bolt 24 preferably are sturdy and light weight. For example, the type of plastic for crank 18 may be acrylate butyl styrene (ABS) and the type of metal for bolt 24 may be steel or aluminum.

As best shown in FIG. 4, threaded portion 48 of bolt 24 has a reduced diameter with respect to that of the shank 21, and forms a shoulder 52 adjacent to threaded portion 48 against which washer 30 abuts as shown in FIG. 3. Shoulder 52 serves as a stop upon tightening of nut 32 on threaded portion 48.

Shank 21 of bolt 24 has an opening or aperture 54 which receives a cable 55, which cable 55, is fixedly secured in aperture 54 in a well-known matter, and which cable operates to open and close cover 12 of umbrella 10 upon rotation of bolt 24 by crank 18 of crank handle assembly 16.

Figure 5:
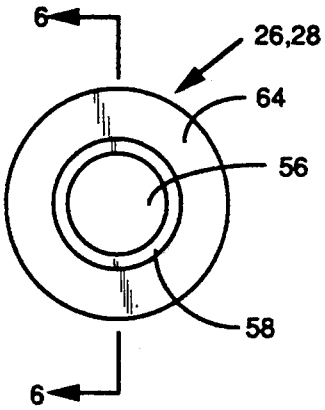
FIG. 5 is an enlarged side elevational view of the spacers of the crank handle assembly of the present invention.
Figure 6:
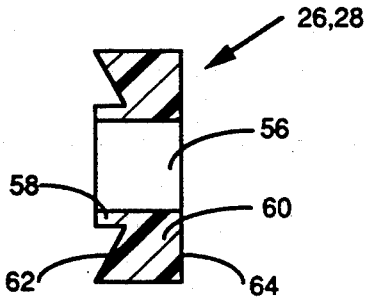
FIG. 6 is an enlarged cross-sectional view taken along lines 6—6 of FIG. 5.

FIGS. 5 and 6 best illustrate the particular construction for spacers 26 and 28. Each spacer 26 and 28 has an annular passageway 56 for receiving bolt 24 and hub 58 with an annular portion 60. Hub 58 fits into openings 34 and 36 in pole 14. Spacers 26, 28 are preferably substantially rigid in order to efficiently allow rotation of crank handle assembly 16. Spacers 26, 28 are preferably made of a wear-resistant plastic, which may be selected from the group consisting of acrylate butyl styrene, nylon, or polycarbonate.

Enlarged annular portion 60 of spacers 26, 28 has an inner surface 62 and an outer surface 64. As can be particularly seen in FIG. 6, inner surface 62 has an arcuate configuration where the two diametrical sides of spacers 26, 28 along, for instance, a central vertical axis, have a greater thickness as compared to the diametrical sides along a central horizontal axis. The arcuate configuration of the two sides of spacers 26, 28 is such that they fit the curvature of pole 14 So that spacers 26, 28 do not rotate when crank 18 is rotated. In FIG. 3 and referring to FIGS. 5 and 6, the inner surface 62 of spacer 26 abuts the outer wall 64 of pole 14, and outer surface 64 of spacer 26 abuts hub 38 of crank 18. The inner surface 62 of spacer 28 abuts the outer wall 64 of pole 14, and outer surface 64 of spacer 28 abuts washer 30 as shown to the left of FIG. 3.

Referring again to FIG. 3, in assembling crank handle assembly 16 to pole 14, annular spacer 26 is placed on bolt 24 which, as discussed hereinbefore, is a unitary piece with crank 18. This pre-assembled unit consisting of crank 18 and bolt 24 is inserted through a circular aperture (not shown) in member 19 of housing 20, and bolt 24 is caused to extend into openings 34 and 36 in pole 14 with hub 58 (FIG. 6) of spacer 26 being received in opening 34 of pole 14. With bolt 24 in a horizontal position as shown in FIG. 3, spacer 28 is mounted on the shank 21 of bolt 24 with the threaded portion 48 of bolt 24 extending cantileverly out of opening 36 of pole 14. Spacer 28 is mounted on shank 21 in the manner shown in FIG. 3, followed by washer 30 and nut 32 being mounted on threaded portion 48 of bolt 24.

Tightening of nut 32 forces washer 30 to bottom out against shoulder 52 of bolt 24 and to abut against spacer 28, and spacer 26 to abut against hub 38 of crank 18, with the arcuate sides of spacers 26, 28 fitting snugly around pole 14. A predetermined compression for crank handle assembly 16 is achieved since the dimensions of bolt 24 and its shoulder 52, the dimensions of spacers 26 and 28, and the dimensions of crank 18 and its components are controlled within very close tolerances.

Once crank handle assembly 16 is secured in pole 14, member 23 of housing 20 is mounted around nut 32 on the left side of pole 14 as shown in FIG. 3, and the two screws, one indicated at 39 are inserted and fastened in the bosses 37 of member 23, and into the bosses 35 of member 19 of housing 20. It will be appreciated that bolt 24 has a square portion (not shown) under head 46 to assure that bolt 24 does not spin in hub 38 as crank 18 is rotated to raise and lower cover 12 of umbrella 10.

Some examples for the dimensions of the components of crank handle assembly 16 of the invention are as follows:

The distance from shoulder 52 of bolt 24 to the shoulder of hub 38 of crank 18 is about 1.595 inches. This dimension preferably is held to about 0.005 inches in order to control the compression on pole 14.

The distance from the shoulder of hub 38 of crank handle 18 to the end of threaded portion 48 of bolt 24 is about 1.908 inches.

The distance from the end of crank 18 along the termination of recess cavity 44 to the end of threaded portion 48 of bolt 24 is about 3.064 inches.

The outer diameter of the shank 21 of bolt 24 is about 0.312 inches. The dimensions for the outer diameter of hub 38 of crank 18 varies such that hub 38 tapers inwardly from the end of head portion 46 to and along shank 21 of bolt 24. For instance, this dimension near crank 18 may preferably be about 0.750 inches. This tapering allows crank 18 to be easily inserted into the opening in member 19 of housing 20, and is necessary to assure proper release from member 19.

In FIG. 3, it can be seen that hub 38 has a notched section indicated at 41. This notched section 41 allows for a chamfer on the area of the mold used in the molding process where bolt 24 is inserted prior to closing of the mold and injecting of the material around bolt 24 for forming crank handle assembly 16. In the molding process, bolt 24 is manually inserted into the mold by the mold press operator.

With regard to spacers 26, 28, the outer diameter of annular portion 60 is about 0.755 inches, the inner diameter of passageway 56 is about 0.327 inches, and the outer diameter of hub 58 is about 0.437 inches. The thickness of the two diametrical opposed portions of annular portion 60 having the arcuate configuration as shown in FIG. 6 for fitting around pole 14, which would be from the outer surface of annular portion 60 to the outer annular surface of hub 38 is about 0.233 inches. The radius of the two arcuate portions of annular portion 60 of spacers 26, 28 is about 0.688 when considered from a horizontal center line. The thickness from the outer surface of annular portion 60 to a horizontal plane where hub 38 begins relative to annular portion 60 is about 0.120 inches, and the distance from this horizontal plane to the outer surface of hub 38 is about 0.115 inches. It is to be noted that the extreme tip of the inwardly projecting section of annular portion 60 extends approximately to the end of hub 38 so that this extreme tip lies in the same vertical plane as the outer surface of hub 38 when viewing FIG. 6.

It will be appreciated that the invention provides an improved crank handle assembly and an improved means for securing the crank handle assembly to an umbrella pole by employing a unitary crank handle and bolt assembly, and certain unique accessories, such as insert bushings or spacers, which in addition to the construction of bolt 24, acts as stop members to apply a predetermined amount of compressive force to the crank handle assembly 16 and pole 14.

Whereas, particular embodiments have been described above for purposes of illustration, it will be appreciated by those skilled in the art that numerous variations of the details may be made without departing from the invention as described in the appended claims.

In accordance with the provisions of the patent statutes. We have explained and described what we consider to be the best embodiment thereof.

We claim:

1. An umbrella, comprising:

a collapsible cover, means for operatively moving said cover between open and closed positions, a hollow pole supporting said cover and having aligned openings, a crank handle assembly mounted in said pole, and including a rotatable, external crank and elongated bolt means transversely extending across said pole and through said aligned openings in said pole, a flexible cable extending within said hollow pole, one end portion of said cable being connected to said means for moving said cover, and the other end portion of said cable being connected to said bolt means, and said cable being wound around said bolt upon rotation of said crank for operation of said umbrella, said bolt means having a head portion which is insert molded in said handle to form a unitary piece consisting of said bolt means and said crank, and said head portion being fixedly secured in said crank for rotation therewith upon said rotation of said crank in said operation of said umbrella, and securing means for securing said crank handle assembly to said pole.

2. An umbrella of claim 1, further comprising:

spacer means mounted on each end of said bolt means and supported in one of said aligned openings for said rotation of said bolt means in said pole upon said rotation of said crank.

3. An umbrella of claim 2, wherein said spacer means further comprises:

hub means having an enlarged outer annular portion, a reduced inner annular portion adjacent to said outer portion, and a passageway for receiving said bolt means, and wherein said annular outer portion has an inward surface with diametrically, opposed arcuate configuration portions extending toward said inner annular portion of said hub means, said arcuate configuration portions corresponding to and fitting around an exterior wall of said pole.

4. An umbrella of claim 2, wherein said bolt means further comprises:

a shank portion around which said cable is wound and having an aperture through which said cable is connected, and a reduced threaded portion adjacent to said shank body portion, said shank portion forming a shoulder adjacent to said reduced threaded portion, and wherein said securing means for securing said crank handle assembly to said pole is mounted on said reduced threaded portion of said bolt means, and is disposed adjacent to and against said shoulder of said bolt means and one of said spacer means such that upon tightening of said securing means, said securing means bottoms out against said shoulder and said one of said spacer means to cause said spacer means on said each end of said bolt means to abut against an exterior wall of said pole to apply a predetermined amount of compressive force on said crank handle assembly and said pole of said umbrella.

5. An umbrella of claim 4, wherein said securing means consists of a washer and nut.

6. An umbrella of claim 4, wherein said shoulder of said bolt means is disposed at the opposite end of said head portion of said bolt means.

7. An umbrella of claim 1, wherein said crank handle has hub means, and wherein said head portion of said bolt means is an integral part of said hub means.

8. An umbrella of claim 7, wherein said bolt means has a shank portion adjacent to said head portion, wherein said hub means of said crank forms a shoulder adjacent to said shank of said bolt means, wherein said crank handle assembly means further comprises spacer means mounted on opposite ends of said bolt means, and wherein said spacer means near said head portion of said bolt means is disposed adjacent to said hub means of said crank.

9. An umbrella of claim 1, wherein said crank is made of a plastic material selected from the group consisting of acrylate butyl styrene, nylon, and polycarbonate, and wherein said bolt means is made of a metal selected from the group consisting of steel and aluminum.

10. An umbrella of claim 1, wherein said crank handle has a hub in which said bolt means is insert molded and further comprises:

housing means extending around said pole for enclosing said crank handle assembly, said housing means consisting of a first member which receives and encloses an end of said elongated bolt means opposite to said head portion of said bolt means and extending through said pole, and a second member which has an opening for receiving and housing the head portion of said bolt means and said hub of said crank.

11. A crank handle assembly, comprising:

a crank, and compression means for placing said crank handle assembly in compression, and wherein said compression means and said crank are a unitary, insert-molded piece with said compression means being fixedly secured in said crank such that when said compression means and said crank rotate in a complete circular path said compression means and said crank will remain fixed relative to one another.

12. A crank handle assembly of claim 11, wherein said compression means is a bolt having a head portion, a shank portion adjacent to said head portion, and a reduced threaded diameter portion adjacent to said shank portion whereby a shoulder is formed by said shank portion adjacent to said threaded portion.

13. A crank handle assembly of claim 11, wherein said crank and said compression means are adapted to be mounted in a hollow body for operation of an external device, and wherein said compression means is capable of extending transversely in and through aligned openings in the walls of said hollow body, and further consisting of securing means for mounting said crank handle assembly to said hollow body.

14. A crank handle assembly of claim 13, wherein said compression means is a bolt having two ends and said crank handle assembly further comprises:

spacer means mounted on each of said two ends of said bolt and allowing rotation of said bolt upon rotation of said crank.

15. A crank handle assembly of claim 14, wherein said spacer means acts as bushings for said rotation of said crank.

16. A crank handle assembly of claim 14, wherein said spacer means further comprises:

hub means having an enlarged outer annular portion, a reduced inner annular portion adjacent to said outer portion, and a passageway for receiving said bolt, and wherein said annular outer portion has an inner curved surface with diametrically opposed arcuate configuration portions extending toward said inner annular portion of said hub means, said arcuate configuration portions corresponding to and fitting around an external surface of said walls of said hollow body.

17. A crank handle assembly of claim 14, wherein said bolt has a head portion and a shank portion adjacent to said head portion, and a reduced threaded diameter portion adjacent to said shank portion, said shank portion forming a shoulder adjacent to said reduced threaded portion, and wherein said securing means is mounted on said threaded portion of said bolt and is disposed adjacent to and against said shoulder of said bolt and one of said spacer means such that upon tightening of said securing means, said securing means bottoms out against said shoulder and said one of said spacer means.

18. A crank handle assembly of claim 17, wherein said securing means consists of a washer and a nut.

19. A crank handle assembly of claim 11, further including means for connecting said crank handle assembly to an external device for operation of said external device.

20. A crank handle assembly of claim 12, wherein said crank has hub means, and wherein said head portion of said bolt is an integral part of said hub means.

21. A crank handle assembly of claim 20, further comprising:

spacer means mounted on opposite ends of said bolt, wherein said hub means of said crank forms a shoulder adjacent to said shank portion of said bolt, and wherein said spacer means near said head portion of said bolt is disposed adjacent to said hub means of said crank.

22. A crank handle assembly of claim 12, wherein said crank and said bolt are formed as a unitary piece by a plastic molding process whereby plastic in liquid form is poured to surround said head portion of said bolt and to form hub means for said crank.

23. A crank handle assembly of claim 12, wherein said crank is made of plastic material selected from the group consisting of acrylate butyl styrene, nylon, and polycarbonate, and said bolt is made of a metal selected from the group consisting of steel and aluminum.

* * * * *